United States Patent [19]

Veillette et al.

[11] 4,306,009

[45] Dec. 15, 1981

[54] LIQUID DEVELOPER COMPOSITIONS WITH A VINYL POLYMERIC GEL

[75] Inventors: Norman T. Veillette, Nashua, N.H.; Charles H. C. Pian, Lexington, Mass.

[73] Assignee: Nashua Corporation, Nashua, N.H.

[21] Appl. No.: 109,393

[22] Filed: Jan. 3, 1980

Related U.S. Application Data

[63] Continuation-in-part of Ser. No. 103,544, Dec. 13, 1979.

[51] Int. Cl.[3] ..... G03G 13/10

[52] U.S. Cl. ..... 430/115; 430/117; 430/137; 430/904

[58] Field of Search ..... 430/114, 115, 112, 113, 430/117, 137, 904

[56] References Cited

U.S. PATENT DOCUMENTS

| | | | |
|---|---|---|---|
| 2,891,911 | 6/1959 | Mayer et al. | 430/115 |
| 3,576,744 | 4/1971 | Sharrock et al. | 430/114 |
| 3,753,760 | 8/1973 | Kosel | 430/114 |
| 3,856,745 | 12/1974 | Yamaguchi et al. | 260/42.14 |
| 3,900,412 | 8/1975 | Kosel | 430/114 |
| 3,960,737 | 6/1976 | Kawanishi | 430/114 |
| 3,969,238 | 7/1976 | Tsuneda | 430/114 |
| 3,976,583 | 8/1976 | Herrmann et al. | 430/114 |
| 3,990,980 | 11/1976 | Kosel | 430/114 |
| 3,991,226 | 11/1976 | Kosel | 430/114 |
| 3,997,488 | 12/1976 | Tsubuko | 430/114 |
| 3,998,746 | 12/1976 | Tsuneda | 430/114 |
| 4,019,993 | 4/1977 | Tamai et al. | 430/137 |
| 4,040,970 | 8/1977 | Tsuneda | 430/114 |
| 4,104,183 | 8/1978 | Tsubuko et al. | 430/114 |
| 4,156,034 | 5/1979 | Mukoh et al. | 430/115 |

FOREIGN PATENT DOCUMENTS

| | | |
|---|---|---|
| 1076611 | 6/1964 | United Kingdom . |
| 1135060 | 12/1965 | United Kingdom . |

*Primary Examiner*—Richard L. Schilling
*Assistant Examiner*—John L. Goodrow

[57] ABSTRACT

Disclosed is a developer composition which in use exhibits improved depletion characteristics and produces copies of high image density. The developer comprises an organic carrier containing a pigment system, a charge control agent, and a "gelatex" which acts as a fixitive and a dispersant. The gelatex comprises a carrier-insoluble vinyl polymer and a multiply-branched, vinyl polymer which physically entraps or entangles the carrier-insoluble polymer and is on the borderline of solubility in the carrier. The gelatex component is present in the carrier as a stable dispersion and is substantially uniformly depleted as multiple copies are produced, resulting in a significantly reduced rate of image density deterioration as multiple copies are produced.

17 Claims, 1 Drawing Figure

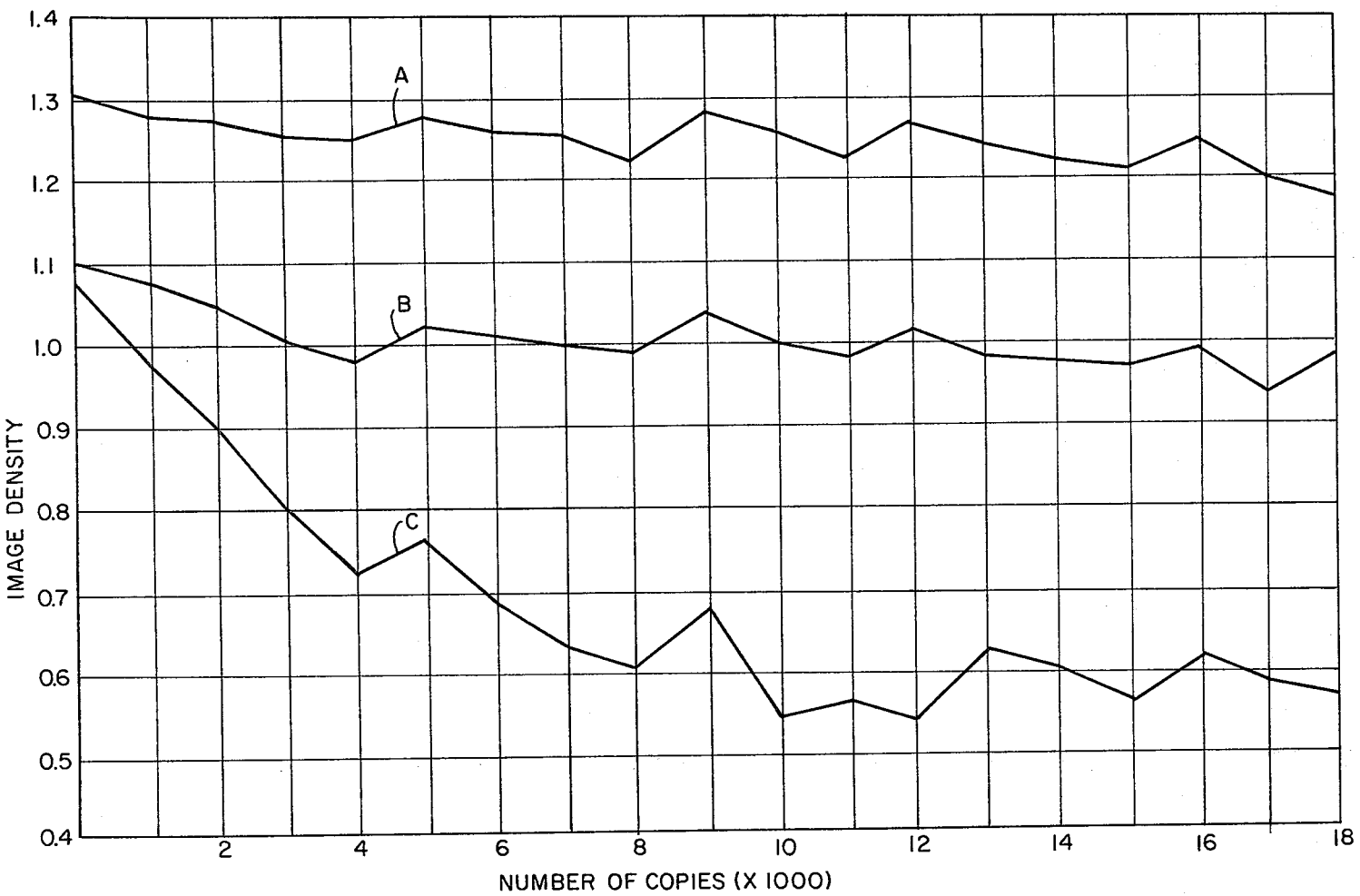
IMAGE DENSITY
1.4
1.3
1.2
1.1
1.0
0.9
0.8
0.7
0.6
0.5
0.4
A
B
C
2
4
6
8
10
12
14
16
18
NUMBER OF COPIES (X 1000)

LIQUID DEVELOPER COMPOSITIONS WITH A VINYL POLYMERIC GEL

REFERENCE TO RELATED APPLICATIONS

This application is a continuation-in-part of copending application Ser. No. 103,544 filed Dec. 13, 1979, the disclosure of which is incorporated herein by reference.

BACKGROUND OF THE INVENTION

This invention relates to electrostatic developer compositions, to a method of manufacturing the compositions, and to an improved imaging method. More particularly, it relates to liquid developer compositions of improved stability and an extended service life which consistently produce copies of a relatively high image density.

Conventional liquid developers for use in electrostatic copying machines consist of an organic nonpolar liquid carrier having a low dielectric constant and a high resistivity containing a toner comprising a solid particulate resinous fixative and a pigment or pigment system. A charge control agent and one or more substances for enhancing the shelf-life of the composition and for maintaining the various solid components as a homogeneously dispersed phase are also included. When a substrate containing a latent electrostatic image is brought into contact with the developer composition, charged components of the developer are attracted preferentially to the oppositely charged latent image and subsequently fixed, typically by the application of heat to evaporate the carrier, to produce a permanent visible image.

In an ideal developing composition, the fixative and pigment should be intimately associated, of uniform small particle size, and should be uniformly charged. This would result in uniform depletion of the toner as images are developed sequentially and in uniform density of the successively produced copies. In practice, this ideal property of developing compositions has been difficult to achieve. The static charge imparted to the solid particles in such a composition by the charge control agent is typically a function of the chemical properties of the agent and the toner particles and of the surface area of the particles. Thus, relatively small differences in particle size result in particles of varying charge, and in use, the larger particles in the composition are preferentially depleted. As a result, the image density of successively produced copies decreases since a given charged area of the latent image on the substrate attract a substantially constant charge, but that quantity of charge is associated with a smaller mass of toner. Also, since the majority of liquid developer compositions contain vehicle-soluble charge control agents, and since the charge control agent is depleted to a lesser extent than the fixative and pigment, as successive copies are produced the net charge on particles remaining in the developer varies in a complicated way resulting in variations in the image density of the copies.

The prior art teaches various approaches to solving this problem, but none have been wholly successful. Currently available copying machines are equipped with means for monitoring the particle density of liquid developers. When the particle density falls below a selected level, developer concentrate and/or vehicle is added to the working developer suspension to adjust the particle density to more optimal levels. However, the image density of successively developed copies nevertheless decreases since the proportion of optimally charged larger sized particles in the working developer becomes smaller. At a point when the image density of the copies falls below an acceptable level, additional relatively large quantities of vehicle are added to the working developer mix, typically by a key operator or a service representative. The result is a marked decrease in the particle density as read by the detector. This low particle density reading triggers the introduction of a relatively large quantity of toner concentrate. Thus, the proportion of ideally charged particles in the developer composition and the image density of subsequently produced copies are sharply increased, but still does not attain the level achieved by fresh developer. As additional copies are made, the developer again becomes gradually depleted, and the cycle of piecemeal replenishment followed by a sharp increase on addition of more vehicle is repeated. After several such cycles, and typically in the 10,000+ copy range, the developer no longer produces copies of acceptable image density and can no longer be upgraded sufficiently. This necessitates removal of the depleted developer and replacement with a completely fresh batch.

To graphically illustrate this phenomenon, image density may be plotted as a function of the number of copies produced. Such a plot shows a gradual decrease in image density as the developer becomes preferentially depleted, despite the piecemeal replenishment of toner, followed by a sharp increase in image density following the addition of a large quantity of developer, and plural repetitions of the cycle at lower image densities until the image density is unacceptable.

SUMMARY OF THE INVENTION

The instant invention provides developer compositions which in use have improved depletion characteristics and produce copies of high image density. Use of the developer in conventional electrostatic copying machines allows upwards of 20,000 copies of high image density to be made before the developer must be replaced. These properties of the developer of the invention may be traced to the inclusion in the composition of a "gelatex". As used herein, the term "gelatex" refers to a mixture of vinyl polymers which together function both as a dispersant and a fixitive, that is, a mixture of a first polymer component on the borderline of solubility in the carrier or sparingly soluble in the carrier (gel component) and a second, carrier-insoluble component (latex). In accordance with the invention, the gelatex consists essentially of a covalently cross-linked, vinyl polymer comprising a three dimensional multiply-branched molecular framework in the form of a gel, and a carrier insoluble vinyl polymeric latex physically entrapped and/or entagled within the three dimensional molecular framework.

In use, the components of developer compositions containing the gelatex are depleted at a substantially uniform rate. Thus, the image density of successively produced copies remains at a desired high level, but the number of copies that can be made per unit volume of toner is essentially identical to prior art toners. Piecemeal additions of toner added to the working developer as it is used upgrade the developer so that copies having an image density quite close to that of fresh developer are possible. Also, less settling of toner components occurs during the useful life of the developer.

The developer compositions of the invention, in addition to the gelatex, include an organic liquid carrier having a resistivity greater than $10^9$ ohm-cm and a dielectric constant less than 3, a charge control agent, and a pigment or pigments system. Desirably, a wood rosin and wax, preferably paraffin wax, are also included. While various conventional charge control agents can be used to impart either a positive or negative polarity to the composition, carrier insoluble charge control agents which have an affinity for the gelatex are preferred. The preferred charge control agent in the manufacture of negative developer compositions made in accordance with the invention is a copolymer of 10–50 parts of a lower alkyl ($C_2$–$C_6$) vinyl ether and 50–90 parts of a vinyl chloride. Optionally the charge control agent may contain trace amounts of covalently bonded anionic surfactant molecules such as $C_{10}$–$C_{40}$ aliphatic hydrocarbons (petroleum fractions) multiply substituted with alkali metal sulfonate groups.

The compositions of the invention are prepared by synthesizing a covalently cross-linked, three-dimensional and multiply-branched vinyl polymeric gel and thereafter synthesizing a carrier insoluble vinyl polymeric latex in the presence of the gel. The reactions are conducted under an inert atmosphere with the aid of a free radical initiator type catalyst such as benzoyl peroxide or azobisisobutyro nitrile. Trace amounts, generally within the range of 0.1–1.2% by weight, of monomer units having 2–5 vinyl moieties attached by covalent bonds are included in the preparation of the gel polymer to obtain the cross-linked, multiply-branched three-dimensional network. Physical entanglement or entrapment of the insoluble latex component is promoted by synthesizing the latex within the formed gel structure. The gelatex is then mixed with the other components of the developer and ball milled in the carrier for a sufficient amount of time to intimately associate all ingredients and to reduce the particular size to the submicron range.

In preferred embodiments, the gel polymer comprises a major amount of monomer units selected from the group consisting of:

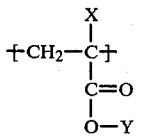

where X is H or $CH_3$ and Y is $C_nH_{2n+1}$ where $8 \leqq n \leqq 20$ and a trace amount of monomer units having 2–5 vinyl moieties attached by covalent bonds, preferably ethylene dimethacrylate. The carrier insoluble latex component of the gelatex is preferably synthesized from a major amount of monomer units selected from the group consisting of:

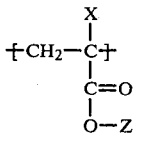

where X is H or $CH_3$ and Z is $C_nH_{2n+1}$ where $1 \leqq n \leqq 6$. Synthesis of these types of polymers may also be accomplished using other monomers. Copolymers of the above-mentioned acrylic and methacrylic acid esters with other vinyl monomers may also be used. The guiding principle in selecting particular polymer systems is that the matrix-like branched component must be on the borderline of solubility in the carrier and the latex component substantially insoluble. Preferably, the respective polymers will also be oxidation resistant and have sufficient structural similarity such that they have an affinity for one another.

Accordingly, objects of the invention include the provision of a liquid negative developer composition for use in electrostatic copying characterized by improved depletion properties, that is, a smaller decrease in image density with successive copies as compared with prior art developers. Another object of the invention is to provide a developer composition which is relatively simple to manufacture and stable both in use and during storage. Another object of the invention is to provide liquid developer compositions which in use continue to produce copies of high image density yet are characterized by the same yield as prior art developers.

These and other objects and features of the invention will be apparent from the following description of some preferred embodiments and from the drawing wherein the sole FIGURE is a plot of image density versus number of copies comparing the depletion properties and image density of the developers of the invention to those of the developers of the aforementioned copending U.S. application and to a commercially available developer.

DESCRIPTION OF THE PREFERRED EMBODIMENT

Broadly, the several objects of the instant invention are accomplished by providing a liquid developer which essentially consists of a carrier or vehicle, a pigment or pigment system, a charge control agent, and a gelatex which comprises a mixture of resinous materials which together behave as a single component and provide both fixative and dispersant functions.

The carriers useful in the composition of the invention are nonpolar solvents or solvent systems of the type conventionally used in prior art liquid developers. The carrier will have a resistivity greater than about $10^9$ ohm-cm and a dielectric constant less than about 3. As known to those skilled in the art, it will be characterized by an evaporation rate suitable for rapid, e.g., two second, evaporations from the substrate to be developed when exposed to temperatures below which paper is charred. It will preferably be free of aromatic liquids and other excessively toxic or corrosive components. Also, as is known, it should have a viscosity low enough to permit rapid migration of particles which are attracted to the electrostatically charged image to be developed. Typically, the viscosity of the vehicle may range between about 0.5 and 2.5 centipoise at room temperature.

Nonlimiting examples of suitable carriers include petroleum fractions which are substantially odorless, relatively inexpensive, and commercially available such as those sold by Humble Oil and Refining Company under the trademarks ISOPAR G, ISOPAR H, ISOPAR K, and ISOPAR L. These materials comprise various mixtures of about $C_8$–$C_{16}$ hydrocarbons.

The pigment or pigment system employed in the composition of the invention is also conventional. The preferred method of imparting color to the toner particles is to use a fine solid particulate pigment in combination with one or more dyes which associate with the composition's resinous components. Carbon black particles in the submicron range are preferred, but powdered metals and metal oxides may also be used. Various dyes of recognized utility in imparting color to vinyl resins may be used in combination with the particulate pigment. The presently preferred pigment system for use in the composition of the invention comprises Printex 140μ, a carbon black sold by Degussa Inc. having a mean particle size of 0.029 microns, plus alkali blue (BASF Wyandotte) and phthalo green (Herculese Inc.).

Vehicle-soluble or vehicle-insoluble charge control agents of known utility which impart either a positive or negative polarity to the developer composition may be used. Non-limiting examples of such materials include cobalt naphthanate, a carrier-soluble material which imparts a positive charge to the developer, dodecyl benzene alkali metal sulfonate, which is sparingly soluble in organic carriers of the type described above and imparts a negative charge to the developer, and various homopolymers or multipolymers of alkali metal salts of acrylic or methacrylic acid which may be engineered to be either soluble or insoluble in the carrier, depending on the concentration and identity of the commonomers (if any) included in their structure, and which impart a negative charge to the developer.

However, the preferred charge control agent for use in the composition comprises a copolymer of 10 to 50 parts of a lower alkyl ($C_2$–$C_6$) vinyl ether and 50 to 90 parts vinyl chloride. It is believed that the chlorinated component of the copolymer is responsible for its ability to impart negative charge to the toner; the lower alkyl group attached to the polymer chain via an ether linkage is believed to be responsible for imparting to the polymer an ability to remain in intimate association with the insoluble resinous components. Generally, as the molecular weight of the alkoxy side chain in the copolymer increases, its affinity for the carrier increases and its affinity for the insoluble resinous components correspondingly decreases. This charge control agent is therefore substantially insoluble in the carrier and remains in intimate association with the resinous components. This property, in combination with its outstanding ability to impart a negative charge to the resinous components of the developer composition, is believed to contribute to the improved depletion properties, to the uniformly high image density and lower rate of image density decrease characteristic of compositions of the invention, and to the high optical density of the copies it produces. In general, the greater the length of the alkoxy side chain within the range specified, the smaller is the fraction of vinyl ether that must be included in the copolymer. The charge control agent is preferably included in the developer such that it constitutes between about 4% and 10% of the total weight of the composition, excluding the carrier.

The currently preferred charge control agent comprises a copolymer of 25 parts isobutyl vinyl ether and 75 parts vinyl chloride. This copolymer is available commercially from BASF Wyandotte Corporation under the trademark LAROFLEX-MP 35. LAROFLEX-MP 35 is synthesized from isobutyl vinyl ether and monochloroethane employing an interfacial polymerization which results in the formation of a latex which is spray dried. The copolymerization is conducted in the presence of anionic surfactants which become mixed with the resin. Attempts to remove the surfactants have led to the conclusion that at least a fraction of the surfactant content is covalently bonded to the copolymer. Typically, the surfactant used is a mixture of saturated and unsaturated aliphatic hydrocarbon chains containing 10–40 carbon atoms multiply substituted with sulfonate groups. These alkali metal petroleum sulfonates are present only in trace quantities and do not adversely affect the properties of the charge control agent. In fact, it is believed that the presence of the anionic surfactants mixed with or covalently bonded to the polymer may enhance its ability to impart a negative charge.

At the heart of the invention is the gelatex which comprises a mixture of two or more polymers or copolymers which are designed to act in tandem to provide both a fixative and a dispersant function and to intimately associate with the pigment system and charge control agent. The gelatex fits the definition of a mixture since its gel and carrier-insoluble components remain unconnected by chemical bonds. However, the components of the gelatex do not depend solely on second order forces for association. Rather, the gel component comprises a covalently cross-linked, multiply-branched, three-dimensional vinyl polymer having a void volume which holds the carrier-insoluble latex component as well as other insoluble components as an inclusion complex or clatherate-like compound by physical entanglement or entrapment. Thus, as toner is removed from the developer in use, there is a marked tendency for all components to deplete at a uniform rate. Developer components thus have a reduced tendency to settle out, and the dispersion exhibits outstanding stability.

Broadly, the gelatex is made by reacting a major amount of monovinyl monomers which, when polymerized, result in a substance on the borderline of solubility in the carrier, together with monomers having 2–5 vinyl moieties attached by covalent bonds. As the number of vinyl moieties in the cross-linker increases, the reaction becomes increasing difficult to control. Di-vinyl compounds are preferred in admixture with $C_8$–$C_{20}$ alkyl esters of acrylic or methacrylic acids. Outstanding results have been achieved with lauryl methacrylate and ethylene dimethacrylate, but other cross-linkers and other monovinyl monomers may be used. Nonlimiting examples of useful cross-linkers include ethylene glycol dimethacrylate, triethyleneglycol, diacrylate, divinyl benzene, pentaerythritol triacrylate, neopentylglycol diacrylate, and 1, 6 hexane diol diacrylate. As will be apparent to those skilled in the liquid developer art, vinyl monomers other than the preferred $C_8$–$C_{20}$ alkyl acrylic or methacrylic acid esters may be used as the monomer used to form the gel. Carrier-insoluble monovinyl monomers may also be included within the gel polymer provided that the resulting branched copolymer nevertheless exhibits the appropriate solubility. The preferred $C_8$–$C_{20}$ alkyl acrylic or methacrylic acid esters may be copolymerized with, for example, glycidyl methacrylate or acrylate, crotonic, maleic, atropic, fumaric, itaconic, and citraconic acids, acrylic, methacrylic, and maleic, anhydrides and acids, acrylonitrile, methacrylonitrile, acrylamide, hydroxy ethyl methacrylate and acrylate, hydroxy propyl methacrylate and acrylate, dimethyl amino methyl methacrylate and acrylate, allyl alcohol, cinnamic acid, methallyl alcohol, propargyl alcohol, mono and dimethyl maleate and fumarate, vinyl pyrrolidone, and others. The important properties of this component of the gelatex are its carrier solubility properties and its highly branched structure. The gel in its reaction medium has the appearance of a translucent, viscous liquid.

Synthesis is conducted using conventional techniques. Thus, the monomer or monomers to be polymerized are added to a suitable vehicle together with about 0.1%–1.2% by weight cross-linker and a free radical initiator type catalyst. Under an inert atmosphere, the reaction is continued, typically for 4–6 hours, at temperatures in the 80° C. range until the reaction rate approaches zero. The fraction of divinyl monomer or other multifunctional cross-linker employed in the reaction medium may be varied as a function of the relative reactivities of the particular divinyl and monovinyl compound employed. Increased concentrations of catalyst result in lower molecular weight copolymers.

The latex components of the gelatex is most preferably polymerized in the presence of the soluble component after production as set forth above. This technique promotes entrapment and/or entanglement of the latex within the gel matrix. Thus one or a combination of vinyl monomers which will result in a polymer which is substantially insoluble in the carrier are added to the product described above together with fresh catalyst and optionally a small amount of cross-linker (e.g. less than about 0.5% by weight). The reaction results in the formation of insoluble polymer chains of widely varying molecular weight formed within and about the gel structure. Again, those skilled in the art will be able to select various vinyl monomers which will result in a polymer of the desired solubility properties. Some unreacted carrier-soluble monomer will often remain after completion of the first reaction stage, and this can be incorporated as copolymer units in the carrier-insoluble latex. Minor amounts of other carrier-soluble monomers may be included as long as the resulting polymer remains substantially insoluble. The ratio of gel polymer to carrier-insoluble polymer in the gelatex can vary generally within the range of 2:1 to 1:2. For the preferred system, the ratio is about 1.1:1. Optionally, the foregoing reactions may be conducted in the presence of the charge control agent and other developer components such as wax. This technique promotes intimate admixture of all components, and some covalent bonds between the gelatex polymers and the wax and/or charge control agent are formed which promote uniform depletion.

The gelatex is then ball milled in the carrier together with the charge control agent, the pigment system, and preferably rosin and wax, for a sufficient amount of time, typically 20–40 hours, to produce a homogeneous blend of all components having a mean particle size in the 0.2–0.3 micron range with particle distribution in the range of about 0.1–1.5 microns. The currently preferred ratios of ingredients are given in the non-limiting examples which follow.

EXAMPLES

Gel Preparation

Gel multipolymers at about 40% solids are prepared by copolymerizing the monovinyl monomers and cross-linkers listed in Tables 1, 2, and 3. The reactions are conducted using azobis isobutyronitrile or benzoyl peroxide (as indicated) in Isopar G under a nitrogen atmosphere for about six hours after reaching 80° C. The data set forth are given in parts by weight unless otherwise specified. The reaction products are translucent solutions which exhibit the Tyndall effect, indicating that the gel is on the borderline of solubility.

TABLE I

| | Multipolymer Number | | | | | | | |
|---|---|---|---|---|---|---|---|---|
| Ingredient | 1 | 2 | 3 | 4 | 5 | 6 | 7 | 8 |
| Lauryl-meth-acrylate | 672.75 | 673 | 673.25 | 673.5 | 688.25 | 688.5 | 697.75 | 698 |
| Vinyl-Pyrrolidone | 75 | 75 | 75 | 75 | 60 | 60 | 50 | 50 |
| Ethylene-dimeth-acrylate | 2.25 | 2 | 1.75 | 1.5 | 1.75 | 1.5 | 2.25 | 2 |
| Acrylic Acid | | | | | | | | |
| Lauryl-Acrylate | | | | | | | | |
| Octadecyl-meth-acrylate | | | | | | | | |
| Dioctyl-maleate | | | | | | | | |
| Dimethyl amino-ethylmeth-acrylate | | | | | | | | |
| meth-acrylic acid | | | | | | | | |
| AIBN[1] | 3.75 | 3.75 | 3.75 | 3.75 | 3.75 | 3.75 | 3.75 | 3.75 |
| $B_2O_2$[2] | | | | | | | | |
| % polymer recovery | 95.5 | 92.5 | 92.7 | 94.3 | 95.1 | 93.7 | 94.5 | 95.2 |
| Reaction conc. (%) | 40 | 40 | 40 | 40 | 40 | 40 | 40 | 40 |

TABLE II

| | Multipolymer Number | | | | | | | |
|---|---|---|---|---|---|---|---|---|
| Ingredient | 9 | 10 | 11 | 12 | 13 | 14 | 15 | 16 |
| Lauryl-meth- | | | | | | | | |

TABLE II-continued

| Ingredient | Multipolymer Number 9 | 10 | 11 | 12 | 13 | 14 | 15 | 16 |
|---|---|---|---|---|---|---|---|---|
| acrylate | 698.25 | 698.5 | 695 | 696 | 697 | 696 | 697 | 696 |
| Vinyl-Pyrrolidone | 50 | 50 | 50 | 50 | 50 | 50 | 50 | 50 |
| Ethylene-dimethacrylate | 1.75 | 1.5 | 2 | 2 | 2 | 2 | 2 | 2 |
| Acrylic Acid | | | 3 | 2 | 1 | 2 | 1 | 3 |
| Lauryl-Acrylate | | | | | | | | |
| Octadecyl-methacrylate | | | | | | | | |
| Dioctyl-maleate | | | | | | | | |
| Dimethyl amino-ethylmethacrylate | | | | | | | | |
| methacrylic acid | | | | | | | | |
| AIBN[1] | 3.75 | 3.75 | 4.25 | 4 | 3.75 | 3.75 | 4.25 | 3.75 |
| $B_2O_2$[2] | | | | | | | | |
| % polymer recovery | 94.5 | 94.7 | 93.9 | 91.2 | 90.4 | 89.1 | 92.4 | 92.2 |
| Reaction conc. (%) | 40 | 40 | 40 | 40 | 40 | 40 | 40 | 40 |

TABLE III

| Ingredient | Multipolymer Number 17 | 18 | 19 | 20 | 21 | 22 | 23 | 24 |
|---|---|---|---|---|---|---|---|---|
| Lauryl-methacrylate | 705 | 706 | 696 | 707.5 | 710 | 275 | 696 | 230 |
| Vinyl-Pyrrolidone | 40 | 40 | 40 | 37.5 | 35 | 20 | | |
| Ethylene-dimethacrylate | 5 | 2 | 2 | 5 | 5 | 0.6 | 2 | 3 |
| Acrylic Acid | | 2 | 2 | | | | 2 | 0.5 |
| Lauryl-Acrylate | | | | | | | 50 | |
| Octadecyl-methacrylate | | | | | | | | 20 |
| Dioctyl-maleate | | | 10 | | | | | |
| Dimethyl amino-ethylmethacrylate | | | | | 4 | | | |
| methacrylic acid | | | | | | | | 2 |
| AIBN[1] | 3.75 | 4 | 4 | 3.75 | 3.75 | 1.5 | 4 | |
| $B_2O_2$[2] | | | | | | | | 1.8 |
| % polymer recovery | 90.3 | 92.0 | 92.5 | 90.3 | 91.3 | 86.8 | 92.2 | 90.1 |
| Reaction conc. (%) | 40 | 40 | 40 | 40 | 40 | 40 | 40 | 40 |

[1]Azobis isobutyronitrile
[2]Benzoyl peroxide

Gelatex Production

The gel polymers dispersed in isopar produced as set forth above are used as a reaction medium to conduct a latex polymerization. The amount and identity of the various monomers used and other data pertinent to the reaction are set forth below. These reactions are conducted in about 580 g Isopar G under a nitrogen atmosphere for about five hours after the reaction medium reaches 80° C. The product form described as a "VIS GLT" is preferred. Data are given in parts by weight unless otherwise specified. The resulting gelatex compositions comprise an opaque, viscous latex.

TABLE IV

| Ingredient | Gelatex Number 1 | 2 | 3 | 4 | 5 | 6 | 7 | 8 |
|---|---|---|---|---|---|---|---|---|
| multipolymer used from example | 1 | 2 | 3 | 4 | 5 | 6 | 7 | 8 |
| multipolymer conc. (% solids) | 38.5 | 37.4 | 37.5 | 38.0 | 38.25 | 38.5 | 38.1 | 38.4 |
| multipolymer used (wet) | 165 | 283.4 | 282 | 278 | 277 | 303 | 306 | 276 |
| (dry) | 63.5 | 106 | 106 | 105.7 | 106 | 116.6 | 116.6 | 106 |
| Methyl methacrylate | 54 | 90 | 90 | 90 | 90 | 99 | 99 | 90 |
| Methacrylic acid | 2.4 | 4 | 4 | 4 | 4 | 4.4 | 4.4 | 4 |
| Ethylene dimethacrylate | | | | | | | | |
| Cellolyn[3] Wax | | | | | | | | |
| AIBN[1] | 0.35 | 0.75 | 0.75 | 0.75 | | | | |
| $B_2O_2$[2] | | | | | 0.5 | 0.55 | 0.55 | 0.5 |
| % recovery | | 94.1 | 95.3 | 97.2 | | 97.8 | 88.0 | 97.8 |
| Reaction Conc. (%) | 15 | 30 | 30 | 30 | 30 | 30 | 30 | 30 |
| Form[4] | GEL | VIS GLT | VIS GLT | VIS GLT | GEL | VIS GLT | VIS GLT | VIS GLT |

TABLE V

| Ingredient | Gelatex Number 9 | 10 | 11 | 12 | 13 | 14 | 15 | 16 |
|---|---|---|---|---|---|---|---|---|
| multipolymer used from example | 9 | 10 | 11 | 12 | 13 | 14 | 15 | 16 |
| multipolymer conc. (% solids) | 38.1 | 38.2 | 37.8 | 37.6 | 37.35 | 36.9 | 37.7 | 37.2 |
| multipolymer used (wet) | 278 | 278 | 841 | 423 | 851.4 | 288 | 844 | 301 |
| (dry) | 106 | 106 | 317.9 | 159 | 318 | 106.2 | 318.1 | 112 |
| Methyl methacrylate | 90 | 90 | 270 | 135 | 270 | 90 | 270 | 80 |
| Methacrylic acid | 4 | 4 | 12 | 6 | 12 | 4 | 12 | 8 |
| Ethylene dimethacrylate | | | | | | | | |
| Cellolyn[3] Wax | | | | | | | | |
| AIBN[1] | | 0.7 | | | | | | |
| $B_2O_2$[2] | 0.6 | | 1.41 | 0.7 | 1.5 | 0.47 | 1.41 | 0.43 |
| % recovery | 94.6 | 93.7 | 100.0 | 93.8 | 100.0 | | 100.0 | 99.3 |
| Reaction Conc. (%) | 30 | 30 | 30 | 18.8 | 30 | 30 | 25 | 30 |
| Form[4] | VIS GLT | VIS GLT | VIS GLT | VIS GLT | VIS GLT | VIS GLT | VIS GLT | VIS GLT |

TABLE VI

| Ingredient | Gelatex Number 16B | 17 | 18 | 19 | 20 | 21 | 22 | 23 | 24 |
|---|---|---|---|---|---|---|---|---|---|
| multipolymer used from example | 16B | 17 | 18 | 19 | 20 | 21 | 22 | 23 | 24 |
| multipolymer conc. (% solids) | 37.2 | 37.3 | 37.7 | 37.2 | 37.4 | 37.2 | 35 | 37.1 | 36.5 |
| multipolymer used (wet) | 298 | 284 | 281.2 | 341.9 | 284 | 285 | 191 | 242.9 | 314 |
| (dry) | 110.8 | 105.9 | 106 | 127.2 | 106.2 | 106 | 66.85 | 127.2 | 110 |
| Methyl methcrylate | 80 | 90 | 90 | 108 | 90 | 90 | 57 | 108 | 90 |
| Methacrylic acid | 8 | 4 | 4 | 4.8 | 4 | 4 | 2.5 | 4.8 | |
| Ethylene dimethacrylate | 0.5 | | | | | | | | |
| Cellolyn[3] | | | | | | | 23 | | |
| Wax | | | | | | | 23 | | |
| AIBN[1] | | | | | | | 0.5 | | 0.5 |
| $B_2O_2$[2] | 0.43 | 0.47 | 0.5 | 0.5 | 0.47 | 0.47 | | 0.5 | |
| % recovery | 98.2 | | 99.7 | 99.8 | | 88.6 | 86.1 | 98.0 | 89.3 |
| Reaction Conc. (%) | 30 | 20 | 25 | 25 | 30 | 22 | 22 | 30 | 16 |
| Form[4] | VIS GLT | GEL | VIS GLT | VIS GLT | GEL | VIS GLT | GEL | GEL | GEL |

[3]Hydroxylated Wood Rosin - (Herculese)
[4]Gel = formation of gel - little turbidity VIS GLT = more viscous, turbid, preferred gelatex compositions As a result of this reaction there are produced turbid (opaque) gelatex compositions comprising a highly branched and cross-linked, lauryl methacrylate containing copolymer gel which act as a matrix for carrier-insoluble linear (or branched in the case of example 16B) latex polymers. The molecular weights of the polymers vary widely between about $10^3$ to about $10^5$, with the soluble component on average in the $10^4$–$10^5$ molecular weight range.

Developer concentrates are prepared by adding to Isopar G the following ingredients so that a dispersion containing 20–25% solids is produced.

| Ingredient | Parts by Weight |
|---|---|
| Gelatex | 30–60 |
| charge control agent | 0.1–10 |
| wax | 5–15 |
| wood rosin | 5–15 |
| pigment | 20–30 |

Preferred compositions consist of, as parts by weight solids:

| Ingredient | Parts bt Weight |
|---|---|
| Gelatex[1] | 35–60 |
| charge control agent[2] | 4–6 |
| paraffin wax (microfine) | 10 |
| wood rosin[3] | 10 |
| pigment[4] | 25 |

[1]Gelatex 2, 3, 4, 6–13, 15–16B, 18, 19, 21, 23 or 24
[2]isobutyl vinyl ether-vinyl chloride copolymer (Laroflex MP-35)
[3]Herculese Chemical Co. (Cellolyn)
[4]19 parts carbon black, 2 parts alkali blue, 4 parts phthalo green.

The dispersions are next placed in a 1.6 gallon ball mill supplied with steel balls and milled for 20–40 hours. They are then diluted with Isopar G to appropriate concentration (7–8% solids) and milling is continued for another hour. The mean particle size of the compositions is around 0.2–0.3 microns, with particle size distribution around 0.1–1.5 microns. This composition is further diluted to produce a working developer comprising 1–2% solids.

Developer compositions prepared in accordance with the foregoing exemplary procedures have been extensively tested in commercially available copying equipment which utilize negative liquid developer. The developers have been found to be capable of continuous operation without replacement in the twenty thousand plus copy range. The image density of the copies is maintained generally above about 1.1 (in MacBeth density units) for at least about 20,000 copies. In contrast, the image density of the developer of copending U.S. application Ser. No. 103,544 ranges between about 0.9 and 1.1. Many currently marketed negative liquid developers must be replaced in the 10,000–15,000 copy range in order to achieve even acceptable image density. Representative plots of the image density of copies produced versus the number of copies for a currently available liquid negative developer (C), the developer of the copending application noted above (B), and the developers of this invention (A) are shown in the FIGURE.

In view of the foregoing teaching it will be appreciated that various compositions in addition to those specifically disclosed herein can be formulated without departing from the spirit and scope of the invention. Accordingly, other embodiments are within the following claims.

What is claimed is:

1. A liquid developer composition for developing an electrostatic latent image on the surface of an image bearing member, said composition comprising:

an organic liquid carrier having a resistivity greater than $10^9$ ohm-cm and a dielectric constant less than 3;

a charge control agent;

a pigment; and a gelatex consisting essentially of a covalently cross-linked, vinyl polymeric gel on the borderline of solubility in said carrier and comprising a three-dimensional, multiply-branched molecular framework comprising a major amount of monomer units selected from the group consisting of:

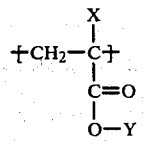

where X is H or $CH_3$ and Y is $C_nH_{2n+1}$, where $8 \leqq n \leqq 20$ and a trace amount of monomer units having 2–5 vinyl moieties attached by covalent bonds; and a carrier-insoluble vinyl polymeric latex physically held within said framework comprising a major amount of monomer units selected from the group consisting of:

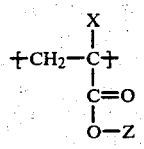

where X is H or $CH_3$ and Z is $C_nH_{2n+1}$, where $1 \leqq n \leqq 6$.

2. The composition of claim 1 wherein said charge control agent comprises a copolymer of 10–50 parts of a lower alkyl ($C_2$–$C_6$) vinyl ether and 50–90 parts of a vinyl chloride.

3. The composition of claim 2 wherein said charge control agent comprises a copolymer of about 25 parts by weight lower alkyl vinyl ether and about 75 parts by weight vinyl chloride.

4. The composition of claim 2 wherein said charge control agent contains covalently bonded anionic surfactant comprising an alkali metal sulfonate substituted aliphatic surfactant containing betwen 10 and 40 carbon atoms.

5. The composition of claim 1 further comprising wax and a wood rosin.

6. In a method of creating an image, the improvement comprising applying under electrostatic control to an electrostatic image bearing member so as to selectively deposit a coating thereon, a liquid electrostatic developer comprising:

an organic liquid carrier having a resistivity greater than $10^9$ ohm-cm and a dielectric constant less than 3;

a charge control agent;

a pigment; and a gelatex consisting essentially of a covalently cross-linked, vinyl polymeric gel on the borderline of solubility in said carrier and comprising a three-dimensional, multiply-branched molecular framework comprising a major amount of monomer units selected from the group consisting of:

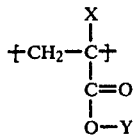

where X is H or $CH_3$ and Y is $C_nH_{2n+1}$, where $8 \leqq n \leqq 20$ and a trace amount of monomer units having 2–5 vinyl moieties attached by covalent bonds; and a carrier-insoluble vinyl polymeric latex physically held within said framework comprising a major amount of monomer units selected from the group consisting of:

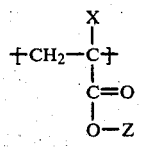

where X is H or $CH_3$ and Z is $C_nH_{2n+1}$, where $1 \leqq n \leqq 6$.

7. The method of claim 6 wherein said charge control agent comprises a copolymer of 10–50 parts of a lower alkyl ($C_2$–$C_6$) vinyl ether and 50–90 parts of a vinyl chloride.

8. The method of claim 7 wherein said charge control agent comprises a copolymer of about 25 parts by weight lower alkyl vinyl ether and about 75 parts by weight vinyl chloride.

9. The method of claim 7 wherein said charge control agent contains covalently bonded anionic surfactant comprising an alkali metal sulfonate substituted aliphatic surfactant containing between 10 and 40 carbon atoms.

10. The method of claim 6 further comprising wax and a wood rosin.

11. A liquid negative developer composition for developing an electrostatic latent image on the surface of an image bearing member, said composition comprising:

an organic liquid carrier having a resistivity greater than $10^9$ ohm-cm and a dielectric constant less than 3;

a charge control agent comprising a copolymer of 10–50 parts of a lower alkyl ($C_2$–$C_6$) vinyl ether and 50–90 parts of a vinyl chloride;

a pigment; and a gelatex consisting essentially of a covalently cross-linked, vinyl polymeric gel on the borderline of solubility in said carrier and comprising a three-dimensional, multiply-branched molecular framework having a major amount of monomer units selected from the group consisting of:

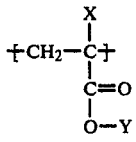

where X is H or $CH_3$ and Y is $C_nH_{2n+1}$, where $8 \leqq n \leqq 20$ and a carrier-insoluble vinyl polymeric latex physically held within said framework and having a major amount of monomer units selected from the group consisting of:

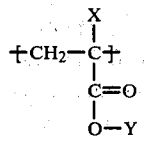

where X is H or $CH_3$ and Y is $C_nH_{2n+1}$, where $1 \leqq n \leqq 6$.

12. The composition of claim 11 comprising wax and a wood rosin.

13. The composition of claim 12 comprising the following ingredients in the following parts by weight, dispersed in said carrier:

| Ingredient | Parts by Weight |
|---|---|
| gelatex | 30–60 |
| pigment | 20–30 |
| charge control agent | 0.1–10 |
| wood rosin | 5–15 |
| wax | 5–15 |

14. The composition of claim 12 comprising the following ingredients in the following parts by weight, dispersed in said carrier:

| Ingredient | Parts by Weight |
|---|---|
| gelatex | 35–60 |
| pigment | 25 |
| isobutyl vinyl ether-vinyl chloride polymer | 4–6 |
| parrafin wax | 10 |
| wood rosin | 10 |

15. A method of manufacturing a liquid developer composition comprising the steps of:

A. reacting in a reaction medium at least one monovinyl monomer with a trace amount of monomer units having 2–5 covalently attached vinyl moieties to produce a gel-like three-dimensional, multiply-branched vinyl polymeric molecule on the borderline of solubility in organic liquid carriers having a resistivity greater than $10^9$ ohm-cm and a dielectric constant less than 3;

B. reacting in the presence of the product of step A at least one monovinyl monomer to produce a polymeric latex, insoluble in said carriers, and physically held within the framework of the multiply-branched product of step A;

C. adding a charge control agent and a pigment to said reaction medium;

D. milling the product of step C to produce a substantially homogeneous dispersion; and E. diluting the product of step D with an organic liquid carrier having a resistivity greater than $10^9$ ohm-cm and a dielectric constant less than 3.

16. The method of claim 15 wherein the charge control agent added in step C comprises a copolymer of 10–50 parts of a lower alkyl ($C_2$–$C_6$) vinyl ether and 50–90 parts of a vinyl chloride.

17. The method of claim 15 wherein a wood rosin and a wax are included in said reaction medium.

* * * * *